US010894992B2

(12) United States Patent
Tawa et al.

(10) Patent No.: US 10,894,992 B2
(45) Date of Patent: Jan. 19, 2021

(54) METHOD FOR PRODUCING STEEL MEMBER

(71) Applicant: TOYOTA JIDOSHA KABUSHIKI KAISHA, Toyota (JP)

(72) Inventors: Hiroyoshi Tawa, Okazaki (JP); Hiroyuki Inoue, Aichi-gun (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 142 days.

(21) Appl. No.: 16/248,838

(22) Filed: Jan. 16, 2019

(65) Prior Publication Data

US 2019/0226037 A1 Jul. 25, 2019

(30) Foreign Application Priority Data

Jan. 25, 2018 (JP) ..... 2018-010322

(51) Int. Cl.

| | |
|---|---|
| ***C23C 8/22*** | (2006.01) |
| ***C21D 1/18*** | (2006.01) |
| ***C23C 8/80*** | (2006.01) |
| ***C21D 9/40*** | (2006.01) |
| ***C21D 9/32*** | (2006.01) |
| ***C21D 1/06*** | (2006.01) |
| *C21D 1/09* | (2006.01) |

(52) U.S. Cl.

CPC ..... *C21D 1/18* (2013.01); *C21D 1/06* (2013.01); *C21D 9/32* (2013.01); *C21D 9/40* (2013.01); *C23C 8/22* (2013.01); *C23C 8/80* (2013.01); *C21D 1/09* (2013.01); *C21D 2211/008* (2013.01); *C21D 2211/009* (2013.01)

(58) Field of Classification Search

CPC .... C21D 1/18; C21D 9/40; C21D 9/32; C23C 8/80; C23C 8/22

See application file for complete search history.

(56) References Cited

U.S. PATENT DOCUMENTS

| | | |
|---|---|---|
| 3,337,376 A | 8/1967 | Grange et al. |
| 3,826,694 A | 7/1974 | Woodilla, Jr. et al. |

(Continued)

FOREIGN PATENT DOCUMENTS

| | | |
|---|---|---|
| CN | 103132086 A | 6/2013 |
| JP | 05-279836 | 10/1993 |

(Continued)

*Primary Examiner* — Jessee R Roe

(74) *Attorney, Agent, or Firm* — Oblon, McClelland, Maier & Neustadt, L.L.P.

(57) ABSTRACT

A method for producing a steel member includes carburizing the steel member, pearlitizing austenite, and performing quenching. The pearlitizing of the austenite includes performing a first pearlite precipitation treatment of cooling the steel member to a first temperature lower than an austenite transformation start temperature and higher than 680° C. and holding the steel member at the first temperature to pearlitize a part of the austenite formed in the carburizing of the steel member, and performing a second pearlite precipitation treatment of further cooling the steel member to a second temperature equal to or lower than 680° C. and higher than a nose temperature and holding the steel member at the second temperature to pearlitize the austenite retained in the first pearlite precipitation treatment.

5 Claims, 5 Drawing Sheets

(56) References Cited

U.S. PATENT DOCUMENTS

| | | | | |
|---|---|---|---|---|
| 6,258,179 | B1 | 7/2001 | Takayama et al. | |
| 2010/0084051 | A1 | 4/2010 | Mizuno et al. | |
| 2016/0208354 | A1 | 7/2016 | Tateishi | |
| 2018/0312956 | A1* | 11/2018 | Yamanishi | C22C 38/002 |

FOREIGN PATENT DOCUMENTS

| | | | |
|---|---|---|---|
| JP | 11-117059 | | 4/1999 |
| JP | 2007-262505 | | 10/2007 |
| JP | 2008-63603 | A | 3/2008 |
| JP | 2009-52119 | | 3/2009 |
| JP | 2010-90437 | | 4/2010 |
| JP | 2016-17212 | A | 2/2016 |

* cited by examiner

METHOD FOR PRODUCING STEEL MEMBER

INCORPORATION BY REFERENCE

The disclosure of Japanese Patent Application No. 2018-010322 filed on Jan. 25, 2018 including the specification, drawings and abstract is incorporated herein by reference in its entirety.

BACKGROUND

1. Technical Field

The present disclosure relates to a method for producing a steel member, and more particularly to a method for producing a steel member which is carburized, and then reheated and quenched.

2. Description of Related Art

For example, since a wear resistance or a fatigue strength is required in a steel member such as a gear or a bearing, a hardened layer is formed on a surface layer portion of the steel member. For example, a steel member processed into a product shape is carburized, and then reheated and quenched to form a hardened layer on the surface layer portion of the steel member. Japanese Unexamined Patent Application Publication No. 5-279836 (JP 5-279836 A) discloses a method for producing a steel member in which after carburizing a steel member, the steel member is cooled to a temperature lower than an austenite transformation start temperature (A1) and is held at the lowered temperature, and then the steel member is reheated and quenched.

When the steel member that is austenitized during carburizing is cooled to a temperature lower than the austenite transformation start temperature (A1) and is held at the lowered temperature, a microstructure of the steel member changes from austenite to pearlite. Through reheating of the steel member for quenching, the microstructure changes from pearlite to austenite, and through quenching, the microstructure changes from austenite to martensite. Here, the pearlite has a lamellar structure in which layers made of ferrite (hereinafter referred to as "ferrite layer") and layers made of cementite (hereinafter referred to as "cementite layer") are alternately stacked.

SUMMARY

The method for producing a steel member which is carburized, and then reheated and quenched has the following problems. FIG. 9 is a TTT (Time-Temperature-Transformation) diagram showing isothermal transformation curves of eutectoid steel (C: 0.77 mass %) that was austenitized at 885° C. A horizontal axis represents a logarithmic time (sec), and a vertical axis represents a temperature (° C.). The step of cooling the steel member to a temperature lower than the austenite transformation start temperature (A1) after carburizing the steel member and holding the steel member at the lowered temperature as disclosed in JP 5-279836 A can also be described with reference to FIG. 9.

As shown in FIG. 9, the holding temperature for the pearlite transformation after carburizing (hereinafter referred to as "pearlitization temperature") is lower than the austenite transformation start temperature (A1) and higher than a nose temperature Tn of the isothermal transformation curve. The pearlite transformation starts when the holding time at a pearlitization temperature exceeds a pearlite transformation start curve Ps. When the holding time at the pearlitization temperature exceeds a pearlite transformation completion curve Pf, the pearlite transformation is completed.

As shown in FIG. 9, when the pearlitization temperature is lowered to approach the nose temperature Tn, a lamellar spacing of the pearlite becomes small, and fine pearlite is formed. On the other hand, when the pearlitization temperature is raised to approach the austenite transformation start temperature (A1), the lamellar spacing of the pearlite becomes large, and coarse pearlite is formed.

Since the pearlitization temperature disclosed in JP 5-279836 A is equal to or lower than 680° C., there has been a problem that the lamellar spacing of the pearlite is small, a cementite layer constituting the pearlite disappears by reheating, and a sufficient fatigue strength cannot be obtained after quenching. When the pearlitization temperature is simply raised, the time until the pearlite transformation is completed is abruptly lengthened as shown in FIG. 9, and the productivity is lowered.

The present disclosure provides a method for producing a steel member capable of making a fatigue strength and productivity compatible with each other.

An aspect of the disclosure relates to a method for producing a steel member. The method includes: carburizing a steel member until a carbon concentration becomes higher than a eutectoid composition while heating the steel member to a temperature higher than an austenite transformation completion temperature to be austenitized; pearlitizing austenite formed in the carburizing of the steel member by cooling the steel member to a temperature lower than an austenite transformation start temperature and higher than a nose temperature of an isothermal transformation curve; and performing quenching by reheating the steel member to a temperature higher than the austenite transformation completion temperature and rapidly cooling the steel member after the pearlitizing of the austenite. The pearlitizing of the austenite includes performing a first pearlite precipitation treatment of cooling the steel member to a first temperature lower than the austenite transformation start temperature and higher than 680° C. and holding the steel member at the first temperature to pearlitize a part of the austenite formed in the carburizing of the steel member, and performing a second pearlite precipitation treatment of further cooling the steel member to a second temperature equal to or lower than 680° C. and higher than the nose temperature and holding the steel member at the second temperature to pearlitize the austenite retained in the first pearlite precipitation treatment.

In the method according to the aspect of the present disclosure, the pearlitizing of the austenite includes performing a first pearlite precipitation treatment of cooling the steel member to a temperature lower than the austenite transformation start temperature (A1) and higher than 680° C. and holding the steel member at the lowered temperature to pearlitize a part of the austenite formed in the carburizing of the steel member, and performing a second pearlite precipitation treatment of further cooling the steel member to a temperature equal to or lower than 680° C. and higher than the nose temperature and holding the steel member at the lowered temperature to pearlitize the austenite remaining in the first pearlite precipitation treatment. In the first pearlite precipitation treatment, the lamellar spacing of the precipitated pearlite becomes large, and the cementite layer constituting the pearlite is divided to fine grains and remains by reheating in the performing of the quenching. As a result, the fatigue strength of the steel member after quenching is improved. In addition, through the second pearlite precipitation treatment, it is possible to suppress the time until the pearlite transformation is completed from being lengthened. That is, it is possible to make the fatigue strength and the productivity of the steel member compatible with each other.

In the above aspect, the first temperature may be 710° C. or less. By setting the temperature to 710° C. or less, the processing time can be shortened.

In the above aspect, the second temperature may be 600° C. or more and 650° C. or less. By setting the temperature to 600° C. or more, energy consumed in reheating can be suppressed. By setting the temperature to 650° C. or less, the processing time can be shortened.

In the above aspect, in the carburizing of the steel member, an outer wall of a heat treatment chamber in which the steel member is accommodated may be made of a material that transmits infrared rays, and the steel member may be heated by an infrared heater installed outside the outer wall. Since only the steel member can be heated without heating an atmosphere inside the heat treatment chamber, the steel member can be rapidly cooled when the heater is turned off.

In the above aspect, after the carburizing of the steel member, the pearlitizing of the austenite and the reheating in the performing of the quenching may be continuously performed while the steel member is accommodated in the heat treatment chamber. Since the carburizing of the steel member, the pearlitizing of the austenite, and heating in the performing of the quenching are performed in one heat treatment chamber, the production apparatus of the steel member can be made compact.

According to the aspect of the disclosure, it is possible to provide a method for producing a steel member capable of making a fatigue strength and productivity compatible with each other.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Hereinafter, specific embodiments to which the present disclosure is applied will be described in detail with reference to the drawings. However, the present disclosure is not limited to the following embodiments. In order to clarify the description, the following description and the drawings are appropriately simplified.

First Embodiment

Method for Producing Steel Member

First, referring to FIG. 1, a method for producing a steel member according to the first embodiment will be described. The method for producing a steel member according to the first embodiment is suitable for a method for producing a steel member such as a gear or a bearing which requires a wear resistance and a fatigue strength. The material of the steel member is not particularly limited, and for example, low carbon steel or alloy steel having a carbon concentration of 0.25 mass % or less can be used. Examples of the steel member include JIS-standard chrome-molybdenum steel SCM420 for mechanical construction.

Figure 1:
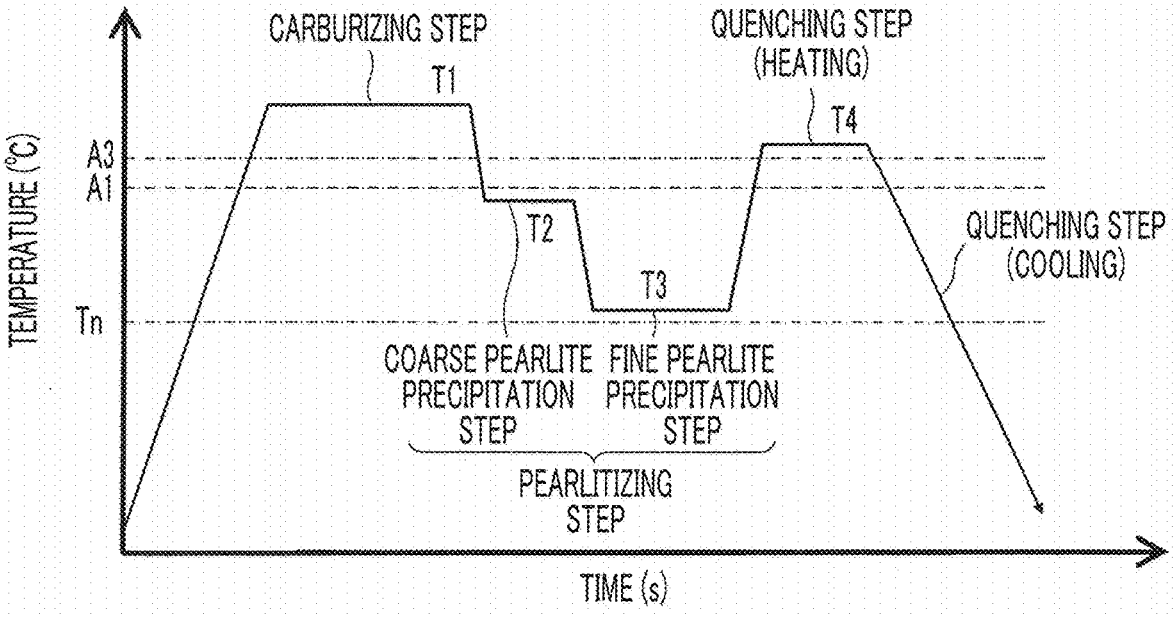
FIG. 1 is a temperature chart showing a method for producing a steel member according to a first embodiment.

FIG. 1 is a temperature chart showing a method for producing a steel member according to the first embodiment. A horizontal axis in FIG. 1 is a time (s), and a vertical axis is a temperature (° C.). As shown in FIG. 1, the method for producing method a steel member according to the first embodiment includes a carburizing step, a pearlitizing step, and a quenching step. In the method for producing a steel member according to the first embodiment, the pearlitizing step is performed after the carburizing step, and then the quenching step is performed. The pearlitizing step includes a coarse pearlite precipitation step (first pearlite precipitation step) and a fine pearlite precipitation step (second pearlite precipitation step).

First, in the carburizing step, the steel member is heated to and held at a temperature T1 higher than an austenite transformation completion temperature A3. The carburizing step is performed until a carbon concentration of a surface of the steel member becomes equal to or higher than a eutectoid composition (C: 0.77 mass %). The temperature T1 is, for example, 950° C. to 1150° C. In the carburizing step, the steel member is austenitized to form an austenite single phase.

As the carburizing method, vacuum carburizing can be used. Specifically, a carburizing gas is introduced into a furnace while an atmosphere in the furnace is depressurized to, for example, 2 kPa or less. As the carburizing gas, for example, a hydrocarbon gas such as acetylene, methane, propane, or ethylene can be used. The carburizing gas decomposes on the surface of the steel member and the generated carbon diffuses from the surface of the steel member toward the inside thereof, whereby a carburized layer is formed on a surface layer portion of the steel member.

Figure 9:
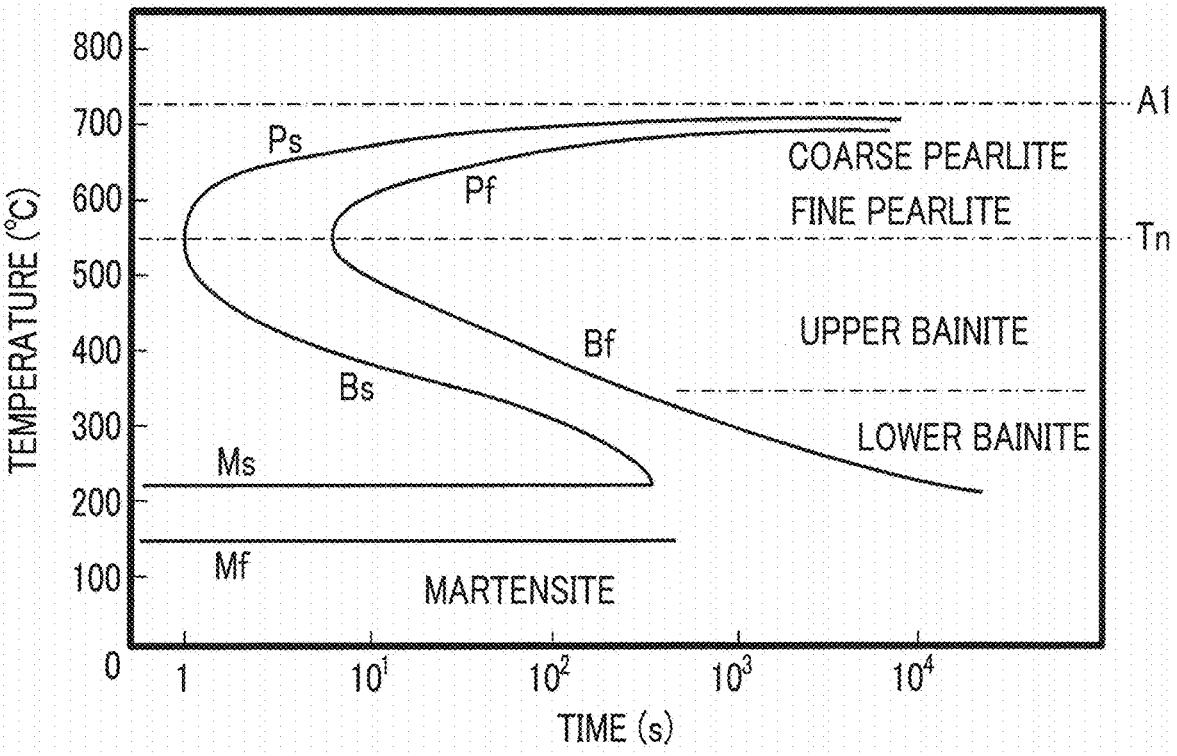
FIG. 9 is a TTT (Time-Temperature-Transformation) diagram of carbon steel having a eutectoid composition (C: 0.77 mass %) austenitized at 885° C.

Next, in the coarse pearlite precipitation step, the steel member is cooled from the temperature T1 in the carburizing step to a temperature T2 lower than the austenite transformation start temperature A1 and higher than 680° C. and is held at the temperature T2. Here, a description will be made with reference to the isothermal transformation curves shown in FIG. 9. In the coarse pearlite precipitation step, the time for holding the steel member at the temperature T2 is made longer than the pearlite transformation start curve Ps and shorter than the pearlite transformation completion curve Pf. The temperature T2 is, for example, 710° C. or less. By setting the temperature T2 to 710° C. or less, the processing time can be shortened. For example, when the temperature T2 is set to 700° C., the holding time may be about 10 minutes.

That is, in the coarse pearlite precipitation step, a part of austenite is transformed to pearlite. Therefore, at the time when the coarse pearlite precipitation step is completed, the microstructure of the steel member becomes a structure in which austenite and pearlite are mixed. In more detail, the surface layer portion of the steel member in which the carbon concentration exceeds the eutectoid composition has a structure in which austenite, pro-eutectoid cementite, and pearlite are mixed. In the inside (i.e., bulk) of the steel member in which the carbon concentration is less than the eutectoid composition has a structure in which austenite, pro-eutectoid ferrite, and pearlite are mixed.

The temperature T2 in the coarse pearlite precipitation step is higher than 680° C. and higher than a temperature T3 in the next fine pearlite precipitation step. Therefore, the lamellar spacing of pearlite formed in the coarse pearlite precipitation step is larger than the lamellar spacing of pearlite formed in the fine pearlite precipitation step.

Next, in the fine pearlite precipitation step, the steel member is cooled from the temperature T2 in the coarse pearlite precipitation step to the temperature T3 and is held at the temperature T3. The temperature T3 is higher than the nose temperature Tn in the isothermal transformation curves shown in FIG. 9 and lower than 680° C. In the fine pearlite precipitation step, all austenite remaining in the coarse pearlite precipitation step is transformed to pearlite. The temperature T3 is, for example, 600° C. to 650° C. By setting the temperature T3 to 650° C. or less, the processing time can be shortened. For example, when the temperature T3 is 650° C., the holding time may be about 30 minutes. On the other hand, by setting the temperature T3 to 600° C. or more, energy consumed in reheating can be suppressed.

At the time when the fine pearlite precipitation step is completed, the entire microstructure of the steel member becomes pearlite. Here, coarse pearlite having a large lamellar spacing formed in the coarse pearlite precipitation step and fine pearlite having a small lamellar spacing formed in the fine pearlite precipitation step are mixed. As described above, pearlite has a lamellar structure in which ferrite layers and cementite layers are alternately stacked.

Finally, in the quenching step, the steel member is heated from the temperature T3 in the fine pearlite precipitation step to a temperature T4 higher than the austenite transformation completion temperature A3 and is held at the temperature T4, and then the steel member is rapidly cooled. Heating at the temperature T4 for the quenching step changes the microstructure from pearlite to austenite, and rapid cooling changes the microstructure from austenite to martensite. By the quenching step, the carburized layer formed on the surface layer portion of the steel member is hardened.

As described above, in the method for producing a steel member according to the first embodiment, the coarse pearlite precipitation step is performed after the carburizing step and before the fine pearlite precipitation step. That is, a part of the austenite is transformed to pearlite at a temperature higher than 680° C. Therefore, in the coarse pearlite precipitation step, the lamellar spacing of the precipitated pearlite becomes large, and the cementite layer constituting the pearlite is divided by reheating in the quenching step and remains as fine grains. As a result, a fatigue strength of the steel member after quenching is improved.

After the coarse pearlite precipitation step, the steel member is cooled from the temperature T2 to the temperature T3, and the pearlite transformation is completed in the fine pearlite precipitation step. Therefore, it is possible to suppress the time until the pearlite transformation is completed from being lengthened. In other words, a decrease in productivity can also be suppressed. In this manner, the fatigue strength and the productivity of the steel member can be made compatible with each other by the method for producing a steel member according to the first embodiment.

An Apparatus for Producing A Steel Member

Figure 2:
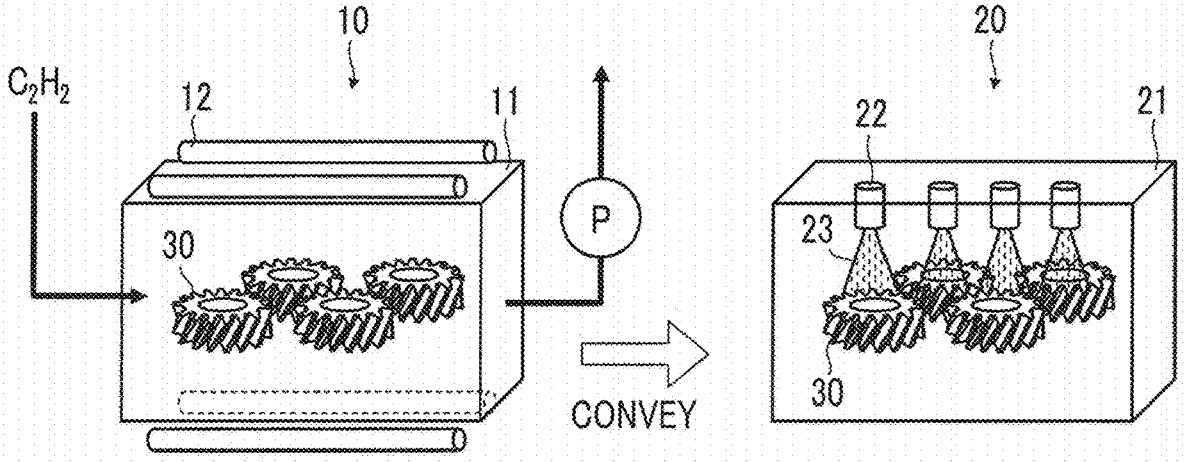
FIG. 2 is a schematic diagram of a production apparatus used in the method for producing a steel member according to the first embodiment.

Next, a production apparatus used in the method for producing a steel member according to the first embodiment will be described with reference to FIG. 2. FIG. 2 is a schematic diagram of a production apparatus used in the method for producing a steel member according to the first embodiment. As shown in FIG. 2, the production apparatus includes a heat treatment device 10 and a cooling device 20. In the production apparatus shown in FIG. 2, the carburizing step, the coarse pearlite precipitation step, the fine pearlite precipitation step, and heating in the quenching step shown in FIG. 1 are continuously performed in the heat treatment device 10. Thereafter, the steel member 30 is conveyed to the cooling device 20, and cooling in the quenching step shown in FIG. 1 is performed.

As shown in FIG. 2, the heat treatment device 10 includes a heat treatment chamber 11, a heater 12, and a vacuum pump P. A steel member 30 is accommodated in the hermetically sealable box-shaped heat treatment chamber 11. In the example of FIG. 2, the steel member 30 is a gear. The heater 12 for heating the steel member 30 is installed outside an outer wall of the heat treatment chamber 11. As the heater 12, for example, an infrared heater can be used. In this case, the outer wall of the heat treatment chamber 11 where the heater 12 is installed is made of a material such as quartz that transmits infrared rays.

As shown in FIG. 2, through heating with the heater 12 (infrared heater) installed outside the outer wall of the heat treatment chamber 11, only the steel member 30 can be heated without heating an atmosphere inside the heat treatment chamber 11. Therefore, the steel member 30 can be rapidly cooled when the heater 12 is turned off. Furthermore, the outer wall of the heat treatment chamber 11 may have a double-wall structure, and when the steel member 30 is cooled, a refrigerant such as a coolant, a cooling gas, or liquid nitrogen may flow between walls. This makes it possible to further shorten the cooling time and improve the productivity.

In addition, when an infrared heater is used as the heater 12, even when a shape of the steel member 30 or the like is changed, the steel member 30 can be uniformly heated, and a setting change becomes unnecessary. Furthermore, as shown in FIG. 2, a plurality of the steel members 30 can be simultaneously heated. Although an induction heater may be used as the heater 12, a setting change becomes necessary in accordance with the shape of the steel member 30 or the like.

As shown in FIG. 2, the inside of the heat treatment chamber 11 can be depressurized by the vacuum pump P. Furthermore, a carburizing gas such as acetylene ($C_2H_2$) can be introduced into the heat treatment chamber 11. In the carburizing step, the carburizing gas such as acetylene ($C_2H_2$) is introduced while the inside of the heat treatment chamber 11 is depressurized by the vacuum pump P. When the carburizing step is completed, the introduction of the carburizing gas is stopped, and the coarse pearlite precipitation step, the fine pearlite precipitation step, and heating in the quenching step are continuously performed while the inside the heat treatment chamber 11 is depressurized by the vacuum pump P.

The cooling device 20 includes a quenching chamber 21 and a refrigerant injection portion 22. The steel member 30 heated for quenching in the heat treatment device 10 is conveyed to the inside of the hermetically sealable box-shaped quenching chamber 21. The refrigerant injection portion 22 is provided in a ceiling portion of the quenching chamber 21, and a refrigerant 23 is injected from the refrigerant injection portion 22 toward the steel member 30. As the refrigerant, water, oil, an inert gas, or the like can be used.

In the production apparatus shown in FIG. 2, since the carburizing step, the pearlitizing step (coarse pearlite precipitation step and fine pearlite precipitation step), and heating in the quenching step are performed by one heat treatment device 10, the production apparatus can be made compact. For example, a preheating chamber (not shown) may be separately provided to heat the steel member 30 in advance before the carburizing step. Since another steel member 30 can be heated in advance in the preheating chamber while the steel member 30 is processed in the heat treatment device 10, the productivity is improved.

Another Production Apparatus for A Steel Member

Figure 3:
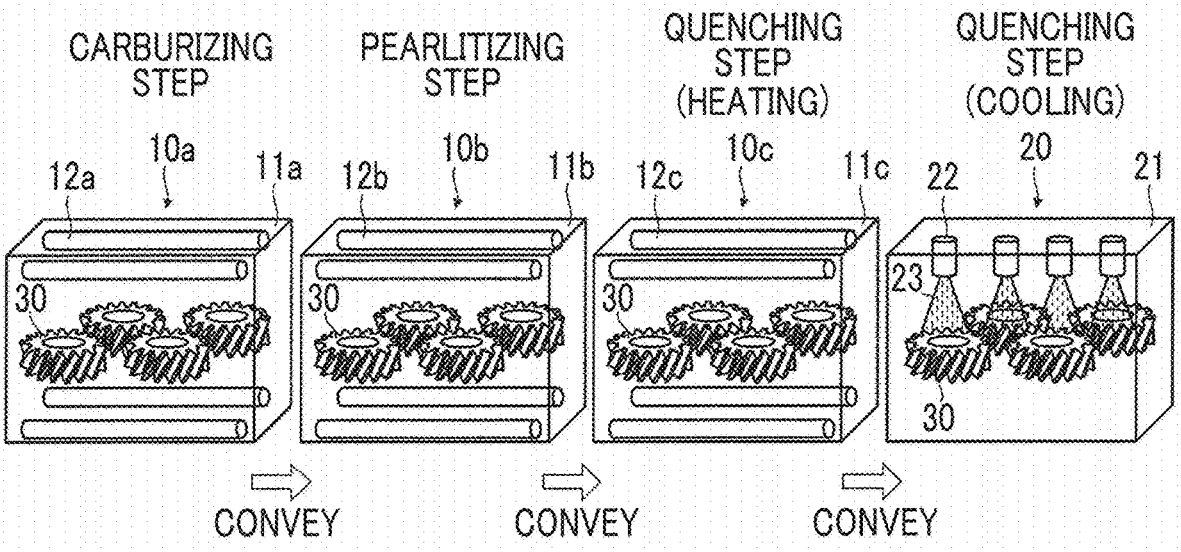
FIG. 3 is a schematic diagram of another production apparatus used in the method for producing a steel member according to the first embodiment.

Next, another production apparatus used in the method for producing a steel member according to the first embodiment will be described with reference to FIG. 3. FIG. 3 is a schematic diagram of another production apparatus used in the method for producing a steel member according to the first embodiment. As shown in FIG. 3, the production apparatus includes a carburizing treatment device 10*a*, a pearlitizing treatment device 10*b*, a quenching-heating device 10*c*, and a cooling device 20.

In the production apparatus shown in FIG. 3, firstly, the carburizing step shown in FIG. 1 is performed in the carburizing treatment device 10*a*. Next, the steel member 30 is conveyed to the pearlitizing treatment device 10*b*, and the coarse pearlite precipitation step and the fine pearlite precipitation step shown in FIG. 1 are performed. Next, the steel member 30 is conveyed to the quenching-heating device 10*c* and heating in the quenching step shown in FIG. 1 is performed. Finally, the steel member 30 is conveyed to the cooling device 20 and cooling in the quenching step shown in FIG. 1 is performed.

As shown in FIG. 3, the carburizing treatment device 10*a* includes a heat treatment chamber 11*a* and a heater 12*a*. Similarly to the heat treatment device 10 shown in FIG. 2, the carburizing treatment device 10*a* can also include the vacuum pump P and introduce the carburizing gas, but such configurations are omitted in FIG. 3. The carburizing treatment device 10*a* is, for example, a general-purpose vacuum heating furnace, and the heater 12*a* for heating the steel member 30 is installed on an inner wall of the heat treatment chamber 11*a*.

As shown in FIG. 3, the pearlitizing treatment device 10*b* includes a heat treatment chamber 11*b* and a heater 12*b*. Similarly to the heat treatment device 10 shown in FIG. 2, the pearlitizing treatment device 10*b* also includes the vacuum pump P, but the vacuum pump P is omitted in FIG. 3. Similarly to the carburizing treatment device 10*a*, the pearlitizing treatment device 10*b* is, for example, also a general-purpose vacuum heating furnace, and the heater 12*b* for heating the steel member 30 is installed on an inner wall of the heat treatment chamber 11*b*.

As shown in FIG. 3, the quenching-heating device 10*c* includes a heat treatment chamber 11*c* and a heater 12*c*. Similarly to the heat treatment device 10 shown in FIG. 2, the quenching-heating device 10*c* also includes the vacuum pump P, but the vacuum pump P is omitted in FIG. 3. Similarly to the carburizing treatment device 10*a*, the quenching-heating device 10*c* is, for example, also a general-purpose vacuum heating furnace, and the heater 12*c* for heating the steel member 30 is installed on an inner wall of the heat treatment chamber 11*c*. Since the cooling device 20 is the same as the cooling device 20 of the production apparatus shown in FIG. 2, the description thereof will be omitted.

In the production apparatus shown in FIG. 2, the carburizing step, the pearlitizing step (coarse pearlite precipitation step and fine pearlite precipitation step), and heating in the quenching step are performed by one heat treatment device 10. In contrast, in the production apparatus shown in FIG. 3, the carburizing step, the pearlitizing step (coarse pearlite precipitation step and fine pearlite precipitation step), and heating in the quenching step are performed by separate devices. Therefore, different steel members 30 can be processed in parallel by the respective devices, and thus the productivity is excellent.

EXAMPLES

Figure 4:
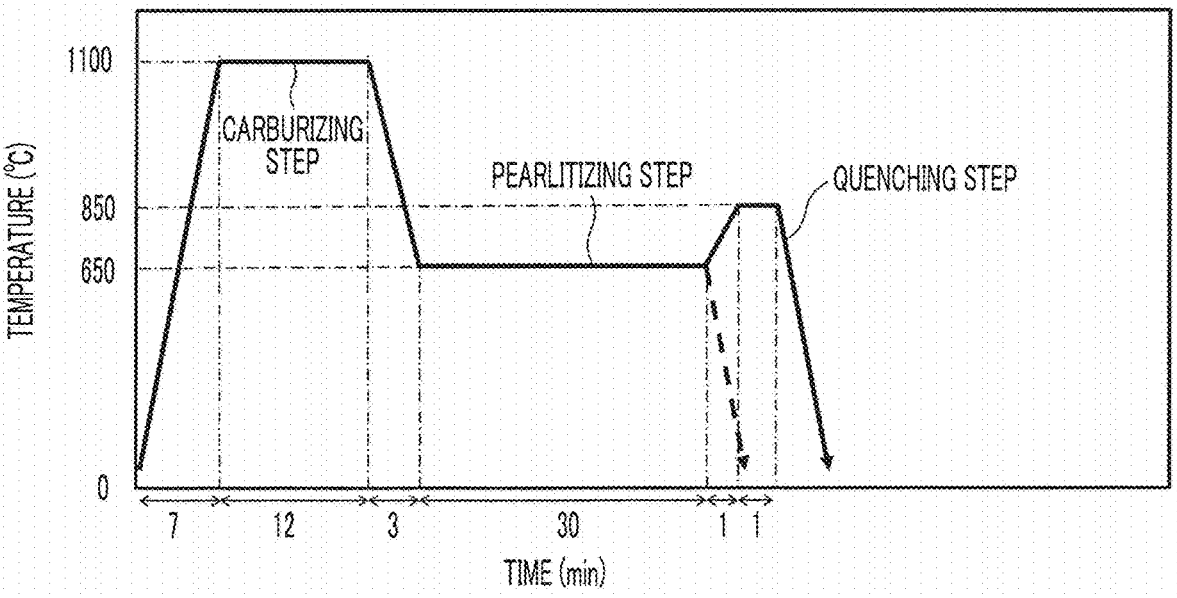
FIG. 4 is a temperature chart showing a method for producing a steel member according to a comparative example of the first embodiment.
Figure 5:
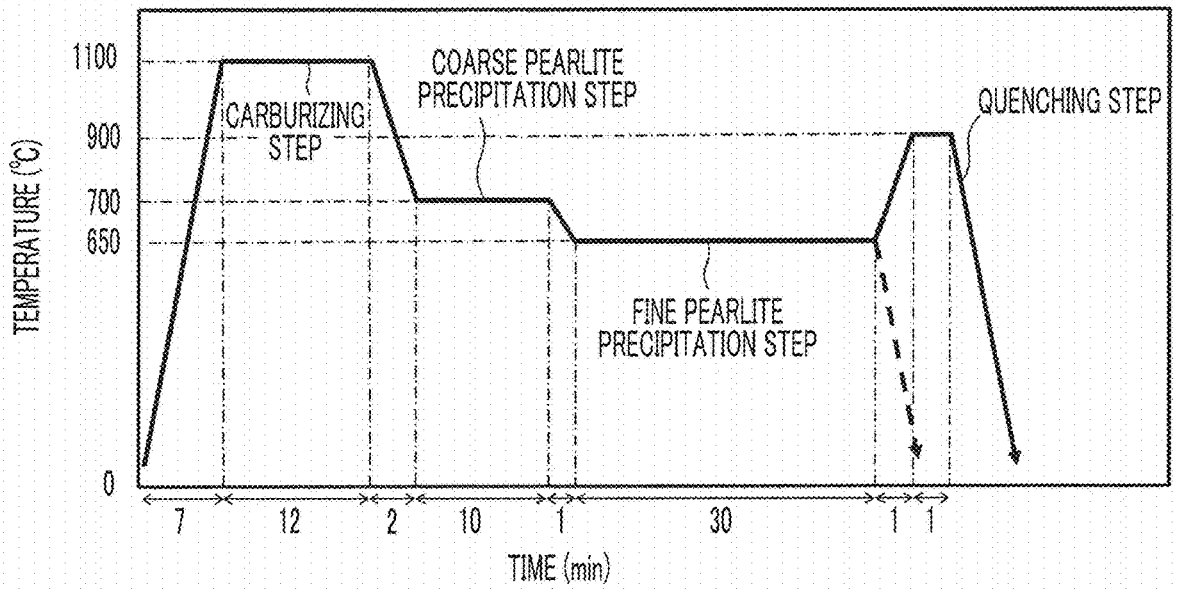
FIG. 5 is a temperature chart showing a method for producing a steel member according to an example of the first embodiment.

Hereinafter, a comparative example and an example of the first embodiment will be described. As the steel member according to the comparative example and the example, a steel member made of JIS-standard SCM420 was used. A shape of a test piece was a round bar shape having a diameter of 26 mm and a length of 130 mm in order to perform a roller pitching fatigue test. FIG. 4 is a temperature chart showing a method for producing a steel member according to the comparative example of the first embodiment. FIG. 5 is a temperature chart showing a method for producing a steel member according to the example of the first embodiment.

First, as shown in FIGS. 4 and 5, carburizing was performed at 1100° C. for 12 minutes for each of the steel members of the comparative example and the example. Next, as shown in FIG. 4, the steel member according to the comparative example was subjected to a pearlitizing treatment at 650° C. for 30 minutes. On the other hand, as shown in FIG. 5, the steel member according to the example was subjected to a coarse pearlite precipitation treatment at 700° C. for 10 minutes, and then subjected to a fine pearlite precipitation treatment at 650° C. for 30 minutes.

Finally, as shown in FIG. 4, the steel member according to the comparative example was heated at 850° C. for one minute, and then was quenched by water cooling. On the other hand, as shown in FIG. 5, the steel member according to the example was heated at 900° C. for one minute, and then was quenched by water cooling.

A Vickers hardness measurement, a microstructure observation, and a roller pitching fatigue test were carried out on the steel members of the comparative example and the example after quenching. In addition, as indicated by a dash line in FIGS. 4 and 5, Vickers hardness measurements and microstructure observations were performed on the steel members of the comparative example and the example which were water-cooled after the pearlitizing treatment (fine pearlite precipitation treatment). As for roller pitching fatigue test conditions, a rotation speed was 2000 rpm, a percentage slippage was −40%, an oil temperature was 80° C., and an oil amount was 1.5 L/min. The lubricant used was JW S3309, which is ATF (Automatic Transmission Fluid).

Figure 6:
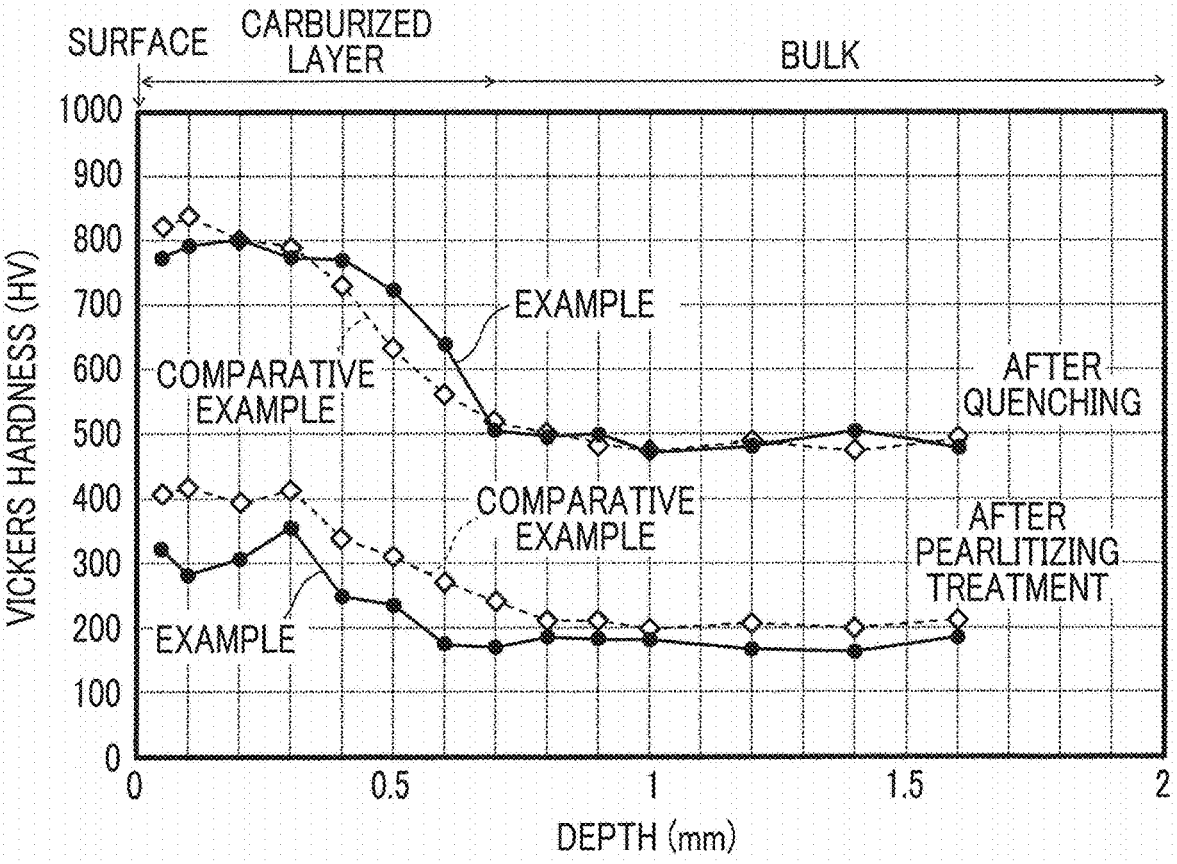
FIG. 6 is a graph illustrating depthwise hardness profiles in steel members according to the comparative example and the example.

FIG. 6 is a graph showing depthwise hardness profiles of the steel members according to the comparative example and the example. A horizontal axis represents a depth (mm) from a surface, and a vertical axis represents a Vickers hardness (HV). In FIG. 6, the Vickers hardness of the steel members according to the comparative example and the example after the pearlitizing treatment and the Vickers hardness of the steel members according to the comparative example and the example after quenching are plotted. As shown in FIG. 6, carburized layers were formed to a depth of about 0.7 mm from the surfaces of both the steel member according to the comparative example and the steel member according to the example.

As shown in FIG. 6, in the carburized layers of the steel members after the pearlitizing treatment, the Vickers hardness of the example was lower than that of the comparative example by about 50 HV to 100 HV. In the steel member according to the example, since the coarse pearlite was precipitated in the coarse pearlite precipitation treatment at a higher temperature than the pearlitizing treatment of the comparative example, it is inferred that the hardness was lowered. On the other hand, as shown in FIG. 6, the Vickers hardness of the steel member after quenching was equivalent in the carburized layers between the comparative example and the example. However, at a depth of 0.4 to 0.6 mm, the Vickers hardness of the example was higher than that of the comparative example.

Figure 7:
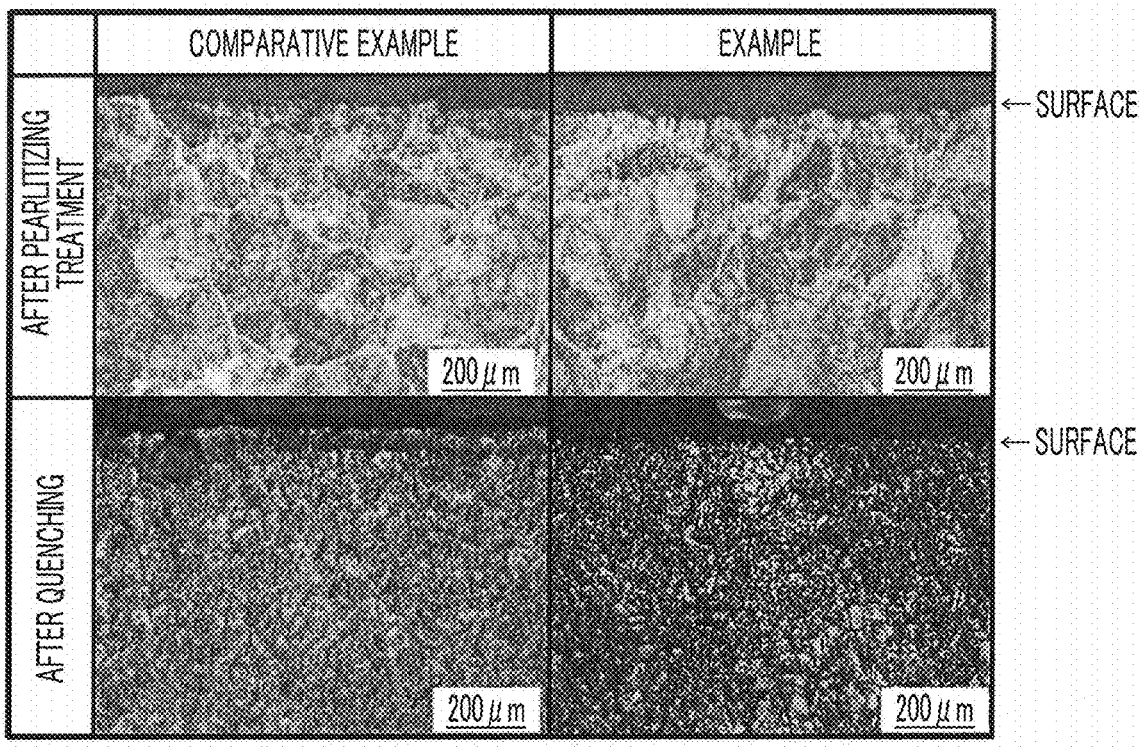
FIG. 7 is a microstructure photograph of the steel members according to the comparative example and the example.

FIG. 7 is a microstructure photograph of the steel members according to the comparative example and the example. FIG. 7 shows the microstructures of the steel members according to the comparative example and the example after the pearlitizing treatment and the microstructures of the steel members according to the comparative example and the example after quenching side by side. As shown in FIG. 7, it was confirmed that the lamellar spacing of the steel member after the pearlitizing treatment was larger in the microstructure of the example than in the microstructure of the comparative example. In the steel member after quenching, cementite was not confirmed in the microstructure of the comparative example, whereas fine grains of cementite were confirmed in the microstructure of the example.

Figure 8:
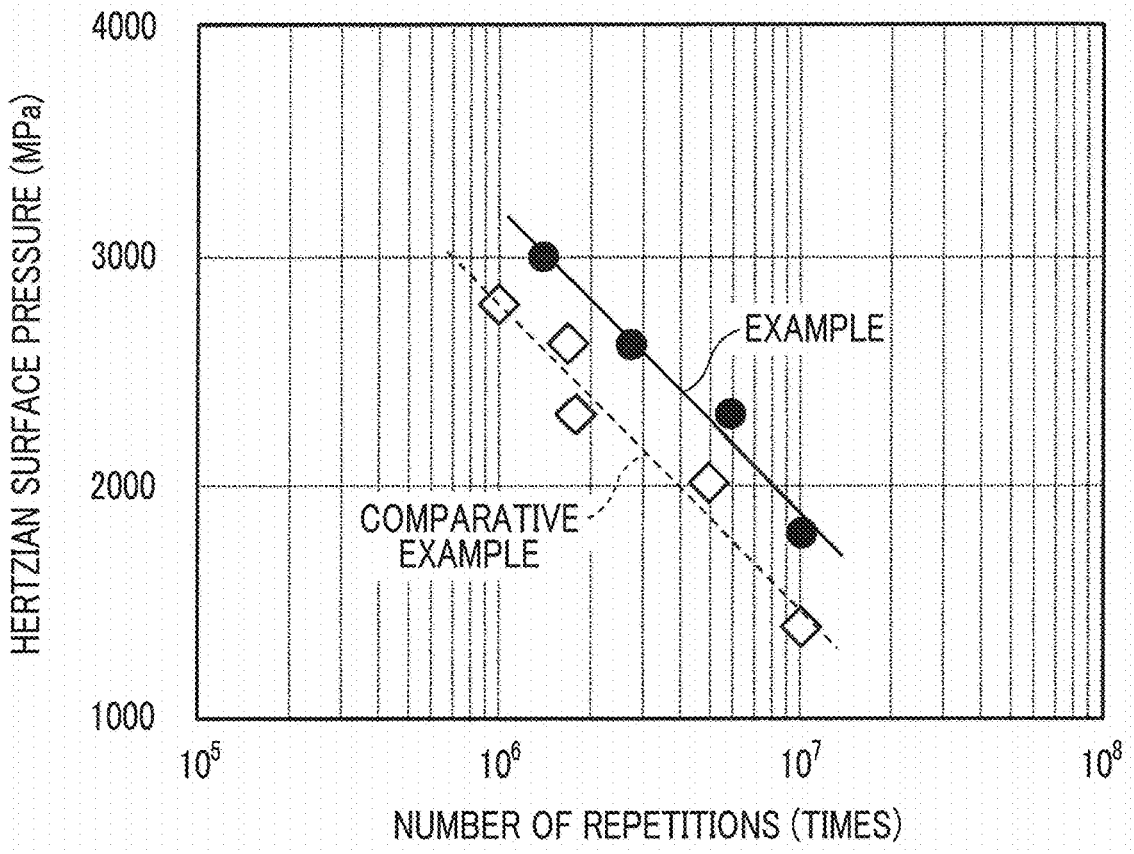
FIG. 8 is a graph showing results of a roller pitching fatigue test of the steel members according to the comparative example and the example after quenching.

FIG. 8 is a graph showing results of roller pitching fatigue tests of the steel members according to the comparative example and the example after quenching. A horizontal axis represents the number of repetitions (times) at which pitching occurred, and a vertical axis represents a Hertzian surface pressure (MPa) applied to the test piece. As shown in FIG. 8, the fatigue strength of the steel member according to the example was about 1.3 times the fatigue strength of the steel member according to the comparative example. Thus, it was confirmed that the fatigue strength of the produced steel member was improved by applying the method for producing a steel member according to the first embodiment.

It should be noted that the present disclosure is not limited to the first embodiment, and can be appropriately modified within a scope not deviating from the gist.

What is claimed:

1. A method for producing a steel member, the method comprising:

carburizing the steel member until a carbon concentration becomes higher than a eutectoid composition while heating the steel member to a temperature higher than an austenite transformation completion temperature to be austenitized;

pearlitizing austenite formed in the carburizing of the steel member, by cooling the steel member to a temperature lower than an austenite transformation start temperature and higher than a nose temperature of an isothermal transformation curve; and performing quenching by reheating the steel member to a temperature higher than the austenite transformation completion temperature and rapidly cooling the steel member after the pearlitizing of the austenite, wherein the pearlitizing of the austenite includes performing a first pearlite precipitation treatment of cooling the steel member to a first temperature lower than the austenite transformation start temperature and higher than 680° C. and holding the steel member at the first temperature to pearlitize a part of the austenite formed in the carburizing of the steel member, and performing a second pearlite precipitation treatment of further cooling the steel member to a second temperature equal to or lower than 680° C. and higher than the nose temperature and holding the steel member at the second temperature to pearlitize the austenite retained in the first pearlite precipitation treatment.

2. The method according to claim 1, wherein the first temperature is 710° C. or less.

3. The method according to claim 1, wherein the second temperature is 600° C. or more and 650° C. or less.

4. The method according to claim 1, wherein in the carburizing of the steel member, an outer wall of a heat treatment chamber in which the steel member is accommodated is made of a material that transmits infrared rays, and the steel member is heated by an infrared heater installed outside the outer wall.

5. The method according to claim 4, wherein after the carburizing of the steel member, the pearlitizing of the austenite and the reheating in the performing of the quenching are continuously performed while the steel member is accommodated in the heat treatment chamber.

* * * * *